US010641081B2

(12) United States Patent
Stack et al.

(10) Patent No.: US 10,641,081 B2
(45) Date of Patent: May 5, 2020

(54) DEVICE AND METHOD FOR RETAINING PROBE EXTERIOR WEAR SLEEVE

(71) Applicant: Evolution Engineering Inc., Calgary, Alberta (CA)

(72) Inventors: Luke Anthony Stack, Calgary (CA); Aaron William Logan, Calgary (CA); Justin Christopher Logan, Calgary (CA)

(73) Assignee: Evolution Engineering Inc., Calgary (CA)

( * ) Notice: Subject to any disclaimer, the term of this patent is extended or adjusted under 35 U.S.C. 154(b) by 0 days.

(21) Appl. No.: 15/550,113

(22) PCT Filed: Feb. 23, 2016

(86) PCT No.: PCT/CA2016/000047
§ 371 (c)(1),
(2) Date: Aug. 10, 2017

(87) PCT Pub. No.: WO2016/134448
PCT Pub. Date: Sep. 1, 2016

(65) Prior Publication Data

US 2018/0030826 A1 Feb. 1, 2018

Related U.S. Application Data

(60) Provisional application No. 62/120,319, filed on Feb. 24, 2015.

(51) Int. Cl.
*E21B 47/01* (2012.01)

(52) U.S. Cl.
CPC ..... *E21B 47/011* (2013.01)

(58) Field of Classification Search
CPC ..... E21B 47/011
See application file for complete search history.

(56) References Cited

U.S. PATENT DOCUMENTS 3,336,054 A * 8/1967 Blount ..... E21B 17/00 285/55
5,178,214 A * 1/1993 Bode ..... E21B 33/16 166/154

(Continued)

FOREIGN PATENT DOCUMENTS

WO 9603568 A1 2/1996
WO 2014071520 A1 5/2014

OTHER PUBLICATIONS

ISA/CA, International Search Report and Written Opinion of PCT Patent Application No. PCT/CA2016/000047, dated May 24, 2016.

(Continued)

*Primary Examiner* — Kristyn A Hall
(74) *Attorney, Agent, or Firm* — Oyen Wiggs Green & Mutala LLP

(57) ABSTRACT

A device and method for retaining a sacrificial wear sleeve on the exterior of an in-pipe device such as an electronics package or probe. In one embodiment, the retention mechanism comprises a ring having a protuberance or lip extending parallel to and against the end of the sleeve, thus pressing the end of the sleeve against the external surface of the device. This has the advantage, in situations where fluids are flowing through the pipe and around the device, of reducing the risk of fluids moving beneath the sleeve and damaging it and/or the underlying device external surface. In another embodiment, the retention mechanism is of unitary construction with the device itself and comprises a protuberance or lip extending parallel to and against the end of the sleeve, thus pressing the end of the sleeve against the external surface of the device.

19 Claims, 5 Drawing Sheets

(56) References Cited

U.S. PATENT DOCUMENTS

| | | | |
|---|---|---|---|
| 6,332,499 | B1 | 12/2001 | Kobylinski et al. |
| 6,439,324 | B1 | 8/2002 | Ringgenberg et al. |
| 7,114,562 | B2 | 10/2006 | Fisseler et al. |

OTHER PUBLICATIONS

WIPO, International Preliminary Report on Patentability of PCT Patent Application No. PCT/CA2016/000047, dated Aug. 29, 2017.

* cited by examiner

DEVICE AND METHOD FOR RETAINING PROBE EXTERIOR WEAR SLEEVE

FIELD OF THE INVENTION

The present invention relates to protective techniques and methodologies for downhole probe external surfaces, and more specifically to the use of sacrificial sleeves as wear members.

BACKGROUND OF THE INVENTION

It is known in the art of downhole probe design to employ covers or coatings to protect the external probe surfaces from undue wear, as abrasive liquid/solid mixtures are often transported in the pipeline or conduit that houses the probe. The covers may be manufactured separately and installed on the external surface of the probe, or they may be in the form of a spray-coating or similar application technique. The cover or sleeve material is commonly in the form of a plastic or metal material, the specific material selected on the basis of the application and the type, volume and velocity of fluid flow around the probe.

For example, U.S. Pat. No. 7,114,562 to Fisseler et al. teaches a measurement-while-drilling apparatus and method wherein the probe is provided with a releasably secured protective cover to protect the probe during drilling.

The use of a plastic sleeve is also known to have potential advantages in the field of downhole electromagnetic telemetry, as commonly-used gap subs employ some degree of electrical isolation for operation. As is taught in Patent Cooperation Treaty Application No. PCT/CA2013/050850 to Logan et al., an electrically insulative coating or sleeve can be used with a gap sub probe.

However, it is known that sleeves can be dislodged by normal fluid flow through a conduit, particularly in the context of drilling fluids or other high-velocity applications, as the fluids can flow beneath the leading or upstream edge of the sleeve and damage it and/or pull it away from the probe external surface, allowing abrasive fluids to damage the probe itself.

Some solutions have been proposed, such as using an adhesive to retain the sleeve against the external probe surfaces, but this makes it more difficult to remove the sleeve. In the situation where the sleeve is sacrificial and is intended to be replaced from time to time, having the sleeve glued in place renders such replacements difficult. Additional time and cost may be required to remove such adhered sleeves, with the potential for damaging the probe itself.

What is needed, therefore, is a means for providing a sacrificial sleeve for the external surface of a probe or other in-conduit device, while securing at least the upstream end of the sleeve to prevent or reduce the risk of fluid getting beneath the sleeve. Preferably, such means would not include the use of adhesives and would allow for easier replacement of worn sleeves.

SUMMARY OF THE INVENTION

The present invention therefore seeks to provide a retention device and method for securing at least an upstream or leading edge of a wear sleeve on the external surface of a device for positioning within a conduit. The present invention extends to conduits, drill collars and gap subs comprising such a device.

According to a first broad aspect of the present invention there is provided a device for positioning within an interior space of a conduit, the device comprising:

- at least one wear member on an external surface of the device; and
- at least one retention member for securing an upstream end of the at least one wear member against the external surface.

In some exemplary embodiments of the first aspect, the wear member forms a sleeve that covers at least a portion of the external surface. The wear member may be composed of a plastic material, with the plastic material preferably selected from the group consisting of thermoplastics, elastomeric polymers and rubber, or polyphenylene sulfide, polyethylene terephthalate or polyether ether ketone. Alternatively, the wear member may be composed of a metal material.

The device may comprise an electronics package or a probe.

The retention member may comprise a lip extending in a downstream direction, the lip configured to press a portion of the upstream end of the wear member against the external surface of the device. Such a lip is preferably circumferential and presses substantially the entire upstream end of the wear member against the external surface of the device.

The retention member may be composed of a metal material, and it may be a ring that secures the upstream end of the wear member against the external surface. In some embodiments, the device further comprises at least one downhole retention member for securing a downstream end of the wear member against the external surface, which downhole retention member may either be mounted on the external surface or of unitary construction with the external surface.

The wear member may be held in position by abutting against an upstream shoulder on the external surface, and the wear member may be further held in position by abutting against a downstream shoulder on the external surface.

The retention member may be composed of a metal selected from the group consisting of beryllium copper and stainless steel, although other metals may be appropriate, or even a ceramic material in certain contexts.

According to a second broad aspect of the present invention there is provided a retention member for securing at least one wear member on an external surface of a device, the device for positioning within an interior space of a conduit, the retention member comprising at least one projection extending adjacent the wear member to hold at least a portion of the wear member against the external surface.

In some exemplary embodiments of the second aspect, the projection comprises a lip extending in a downstream direction, the lip configured to press a portion of the upstream end of the wear member against the external surface of the device. The projection may comprise a circumferential lip extending around the device and generally parallel to the external surface, the circumferential lip configured to press a portion of the upstream end of the wear member against the external surface of the device. The device may comprise an electronics package and/or a probe. The retention member may be composed of a material selected from the group consisting of beryllium copper and stainless steel, although other metals may be appropriate, or even a ceramic material in certain contexts.

According to a third broad aspect of the present invention there is provided a wear assembly for use with a device, the device for positioning within an interior space of a conduit, the device having an external surface, the wear assembly comprising:

a sacrificial sleeve sized and configured for slip-fit engagement with the external surface; and at least one retention member;

the retention member comprising at least one protuberance for securing an upstream end of the sleeve against the external surface.

In some exemplary embodiments of the third aspect, the sleeve is composed of a plastic material, the plastic material deformable when fluid flowing through the conduit flows under the upstream end of the sleeve, the protuberance sized and configured to retain the upstream end of the sleeve against the external surface to reduce the flow of the fluid under the upstream end of the sleeve. The device may comprise an electronics package and/or a probe. The retention member may be composed of a material selected from the group consisting of beryllium copper and stainless steel, although other metals may be appropriate, or even a ceramic material in certain contexts. The conduit may be a drill collar comprising a gap sub assembly, with the sleeve composed of an electrically insulative material. The electrically insulative material is preferably selected from the group consisting of polyphenylene sulfide, polyethylene terephthalate and polyether ether ketone. The protuberance may comprise a circumferential lip adjacent the sleeve, and the device may comprise a shoulder for abutting engagement with the upstream end of the sleeve. In addition, the wear assembly may further comprise at least one downstream retention member for securing a downstream end of the sleeve against the external surface.

According to a fourth broad aspect of the present invention there is provided a gap sub for insertion in a drill string, the gap sub comprising:

a male member;

a female member;

an electrically insulative gap member configured for positioning between the male and female members;

the male and female members and the gap member when connected forming an interior space;

an electronics package for positioning partially within the interior space, the electronics package having an external surface;

a sacrificial sleeve for slip-fit engagement with the external surface; and at least one retention member sized and configured to secure an upstream end of the sleeve against the external surface and reduce introduction under the sleeve of fluid flowing through the gap sub.

In some exemplary embodiments of the fourth aspect, the retention member comprises at least one protuberance for bearing against the upstream end of the sleeve to press the upstream end against the external surface. The protuberance may comprise a circumferential lip. The electronics package may comprise a probe, and the sleeve may be composed of an electrically insulative material.

According to a fifth broad aspect of the present invention there is provided a wear assembly for use with a device, the device for positioning within an interior space of a conduit, the device having an external surface, the wear assembly comprising:

upstream and downstream sleeves sized and configured for slip-fit engagement with the external surface, the upstream and downstream sleeves configured for positioning adjacent one another; and upstream, downstream and central retention members;

the upstream retention member for securing an upstream end of the upstream sleeve against the external surface, the downstream retention member for securing a downstream end of the downstream sleeve against the external surface, and the central retention member for securing both a downstream end of the upstream sleeve and an upstream end of the downstream sleeve against the external surface.

In some exemplary embodiments of the fifth aspect:

the upstream retention member comprises at least one protuberance for securing the upstream end of the upstream sleeve against the external surface;

the downstream retention member comprises at least one protuberance for securing the downstream end of the downstream sleeve against the external surface; and the central retention member comprises at least two protuberances, one for securing each of the downstream end of the upstream sleeve and the upstream end of the downstream sleeve against the external surface.

According to a sixth broad aspect of the present invention there is provided a method of reducing wear of an external surface of a device, the device for positioning within an interior space of a conduit, the method comprising the steps of:

a. providing at least one wear member sized and configured for slip-fit engagement with the external surface;

b installing the wear member on the external surface; and c. engaging retention means to press an upstream end of the wear member against the external surface.

In some exemplary embodiments of the sixth aspect, the wear member is a sacrificial plastic sleeve, it may be composed of a metal material, or it may be composed of an electrically isolative material. The wear member may be sized to cover at least a portion of the external surface.

The retention means may comprise at least one retention member sized and configured for slip-fit engagement with the external surface, and the engaging of the retention means may comprise installing the retention member adjacent the upstream end of the wear member to press the upstream end against the external surface. The retention member may comprise at least one downwardly extending protuberance for pressing the upstream end of the wear member against the external surface. The downwardly extending protuberance preferably comprises a circumferential lip.

According to a seventh broad aspect of the present invention there is provided a method of securing at least one wear member against an external surface of a device, the device for insertion within a conduit, the method comprising the steps of:

a. providing the wear member, the wear member sized and configured for slip-fit engagement with the external surface;

b installing the wear member on the external surface; and c. engaging retention means to press an upstream end of the wear member against the external surface.

In some exemplary embodiments of the seventh aspect the wear member is a sacrificial plastic sleeve. The wear member is preferably sized to cover at least a portion of the external surface. The wear member may be composed of a metal material or an electrically isolative material.

The retention means may comprise at least one retention member sized and configured for slip-fit engagement with the external surface, and the engaging of the retention means may comprise installing the retention member adjacent the upstream end of the wear member to press the upstream end against the external surface. The retention member preferably comprises at least one downwardly extending protuberance for pressing the upstream end of the wear member against the external surface, and the downwardly extending protuberance most preferably comprises a circumferential lip.

A detailed description of exemplary embodiments of the present invention is given in the following. It is to be understood, however, that the invention is not to be construed as being limited to these embodiments. The exemplary embodiments are directed to particular applications of the present invention, while it will be clear to those skilled in the art that the present invention has applicability beyond the exemplary embodiments set forth herein.

BRIEF DESCRIPTION OF THE DRAWINGS

In the accompanying drawings, which illustrate exemplary embodiments of the present invention.

Exemplary embodiments of the present invention will now be described with reference to the accompanying drawings.

DETAILED DESCRIPTION OF EXEMPLARY EMBODIMENTS

Throughout the following description specific details are set forth in order to provide a more thorough understanding to persons skilled in the art. However, well known elements may not have been shown or described in detail to avoid unnecessarily obscuring the disclosure. The following description of examples of the invention is not intended to be exhaustive or to limit the invention to the precise forms of any exemplary embodiment. Accordingly, the description and drawings are to be regarded in an illustrative, rather than a restrictive, sense.

Figure 1:
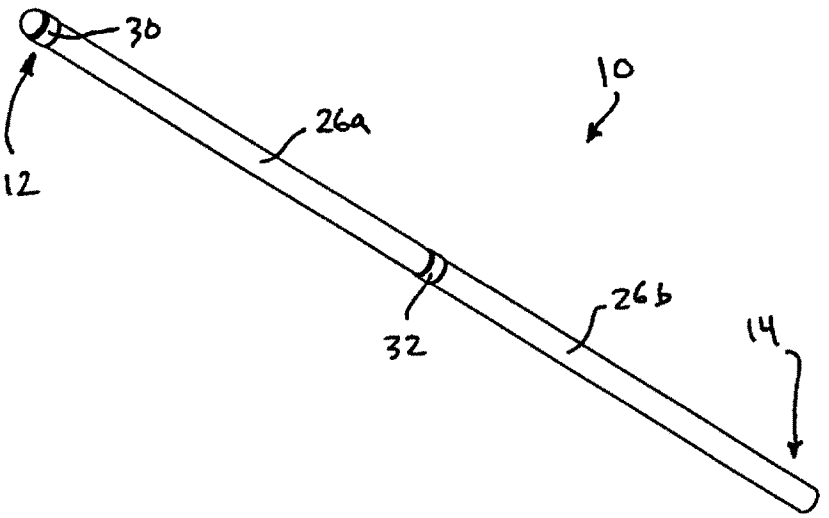
FIG. 1 is a perspective view of a first embodiment of the present invention.
Figure 2:
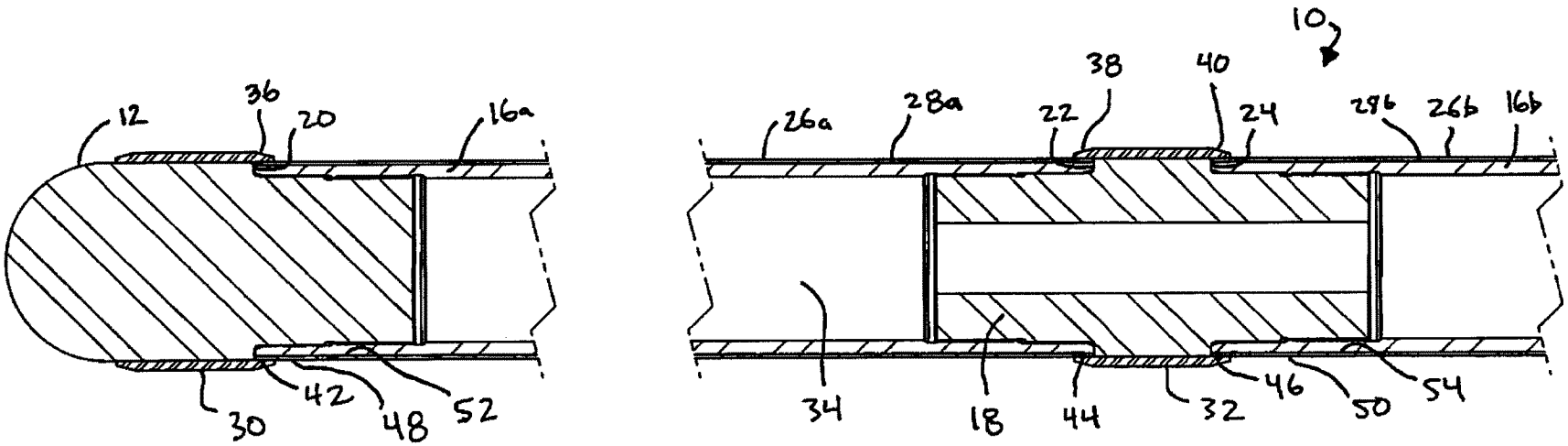
FIG. 2 is a sectional view of the first embodiment.

Turning now to FIGS. 1 and 2, a first embodiment of a device or probe 10 according to the present invention is illustrated. FIG. 1 provides a perspective view of the probe 10 exterior, the probe 10 shown as a conventionally elongate device having an upstream end 14 and a downstream end 12, configured for insertion within a conduit or pipe which may comprise a gap sub. The exterior of the probe 10 is covered by downstream and upstream sleeves 26*a* and 26*b*, with the sleeves 26*a*, 26*b* retained by means of a downstream metal sleeve 30 and a connector metal sleeve 32, as will be described in detail below. While not illustrated in this exemplary embodiment, it will be clear from the following description that an upstream metal sleeve would also be preferably employed to retain the upstream end of the upstream sleeve 26*b*.

Turning to FIG. 2, a detailed sectional view illustrates the structure of this first embodiment. While some devices are conventionally known to employ only a single wear sleeve, the probe 10 as illustrated comprises two sleeves 26*a*, 26*b*. The reason for this is that the illustrated probe 10 comprises two housing sections 16*a*, 16*b* joined by a housing connector 18. As can be seen in FIG. 2, the housing connector 18 engages the downstream end of the upstream housing section 16*b* and the upstream end of the downstream housing section 16*a*. The downstream end 12 of the probe 10 is illustrated as a solid metal plug that engages the downstream end of the downstream housing section 16*a*. The probe 10 as illustrated comprises an interior space 34, for receiving an electronics package or similar components in a conventional manner known to those skilled in the art.

As can be seen in FIG. 2, the downstream end 12 comprises a recessed shoulder 20, against which the downstream housing section 16*a* abuts when the device 10 is assembled. The housing connector 18 comprises a corresponding recessed shoulder 22, such that the downstream housing section 16*a* abuts the shoulders 20, 22 and is thus held in place within the recessed circumferential space. The shoulders 20, 22 are configured to provide additional space on top of the downstream housing section 16*a* for receiving the sleeve 26*a*, such that the sleeve 26*a* is essentially flush with the external surface of the downstream end 12 and the housing connector 18. The inner surface 52 of the sleeve 26*a* thus covers the external surface 28*a* of the downstream housing section 16*a*. Similarly, a shoulder 24 is provided on an upstream side of the housing connector 18 to receive the upstream housing section 16*b* and the upstream sleeve 26*b*, the inner surface 54 of the upstream sleeve 26*b* covering the external surface 28*b* of the upstream housing section 16*b*.

In this exemplary embodiment the sleeves 26*a*, 26*b* are composed of polyphenylene sulfide. In the case of a gap sub application, such a material may provide suitable wear prevention functionality to the sleeves 26*a*, 26*b* while providing a desirable electrical isolation function. Those skilled in the art would be able to readily identify other materials that would be appropriate in a given context or application. The sleeves 26*a*, 26*b* as illustrated are each a one-piece cylindrical sleeve that extends substantially the length of the respective housing section 16*a*, 16*b*. It will be obvious to those skilled in the art that the sleeves 26*a*, 26*b* need not be a one-piece construction in a given application.

With the sleeves 26*a*, 26*b* thus in position, FIGS. 1 and 2 illustrate the exemplary retention means for the sleeves 26*a*, 26*b*. In this particular embodiment, the retaining means comprise a downstream metal sleeve 30 (the corresponding upstream sleeve not shown) and a connector metal sleeve 32. The downstream metal sleeve 30 is provided with a projection or lip 36 which extends over top of the sleeve 26*a*. The downstream metal sleeve 30 is configured for press-fit engagement over the downstream end 12 and the downstream end 42 of the sleeve 26*a*. By pressing the lip 36 against the outer surface 48 of the sleeve 26*a*, the inner surface 52 of the sleeve 26*a* is pressed against the external surface 28*a* of the downstream housing section 16*a*, thus retaining the downstream end 42 of the sleeve 26*a*.

Similarly, the connector metal sleeve 32 functions to retain the sleeves 26*a*, 26*b*. The connector metal sleeve 32 is configured for press-fit engagement over the connector 18 and the adjacent housing sections 16*a*, 16*b*. The connector metal sleeve 32 comprises two opposed lips 38, 40, the lip 38 extending in a downstream direction overlying the sleeve 26*a*, and the lip 40 extending in an upstream direction overlying the sleeve 26*b*. The lip 38 presses against the outer surface 48 of the upstream end 44 of the downstream sleeve 26*a*, such that the inner surface 52 of the sleeve 26*a* is pressed against the external surface 28*a* of the downstream housing section 16*a*, thus retaining the upstream end 44 of the sleeve 26*a*. Likewise, the lip 40 presses against the outer surface 50 of the downstream end 46 of the upstream sleeve 26*b*, such that the inner surface 54 of the sleeve 26*b* is pressed against the external surface 28*b* of the upstream housing section 16*b*, thus retaining the downstream end 46 of the sleeve 26*b*.

In the exemplary embodiment, the sleeves 26*a*, 26*b* are shown as secured by means of a press-fit engagement with the lips 36, 38, 40 and abutting against the shoulders 20, 22, 24. However, it is within the scope of the present invention to have other mechanisms for pressing the sleeves 26*a*, 26*b* against the probe housing sections 16*a*, 16*b*, such as for example a biasing mechanism. Those skilled in the art would be able to readily determine functionally equivalent mechanisms and techniques, all of which are intended to fall within the scope of the present invention as defined in the claims. Also, while the metal sleeves 30, 32 are shown in press-fit engagement, they could be installed using alternative connection means such as threadable engagement.

Figure 3:
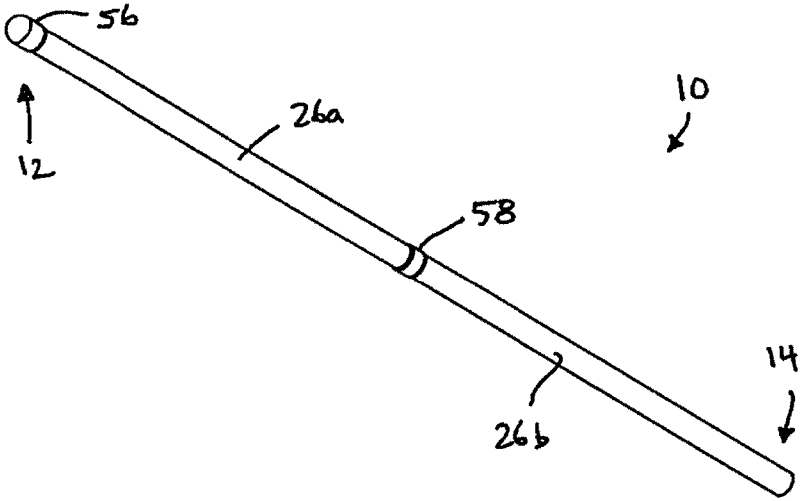
FIG. 3 is a perspective view of a second embodiment of the present invention.
Figure 4:
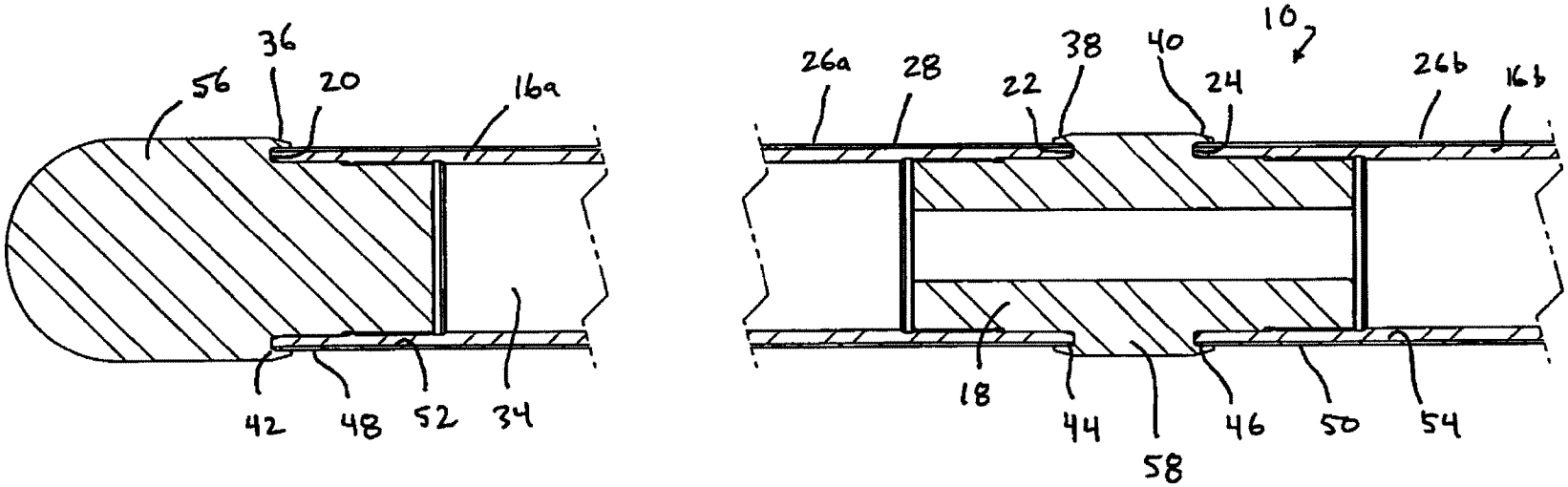
FIG. 4 is a sectional view of the second embodiment.

FIGS. 3 and 4 illustrate a second exemplary embodiment. In this embodiment, the metal sleeves 30, 32 have been replaced by a configuration in which the retaining means are of unitary construction with the downstream end (and the upstream end, not shown) and the connector. Specifically, the probe 10 in this second embodiment comprises a downstream end 56 that comprises the lip 36, rather than having the lip 36 part of a separate retention component. Similarly, the probe 10 in this second embodiment comprises a connector 58 that comprises the lips 38, 40, rather than having the lips 38, 40 part of a separate retention component. The downstream end 56 and the connector 58 could be machined, cast, forged or 3D printed, as would be known to those skilled in the art. The above description with respect to the first embodiment applies in all other respects to this second embodiment.

Figure 5A:
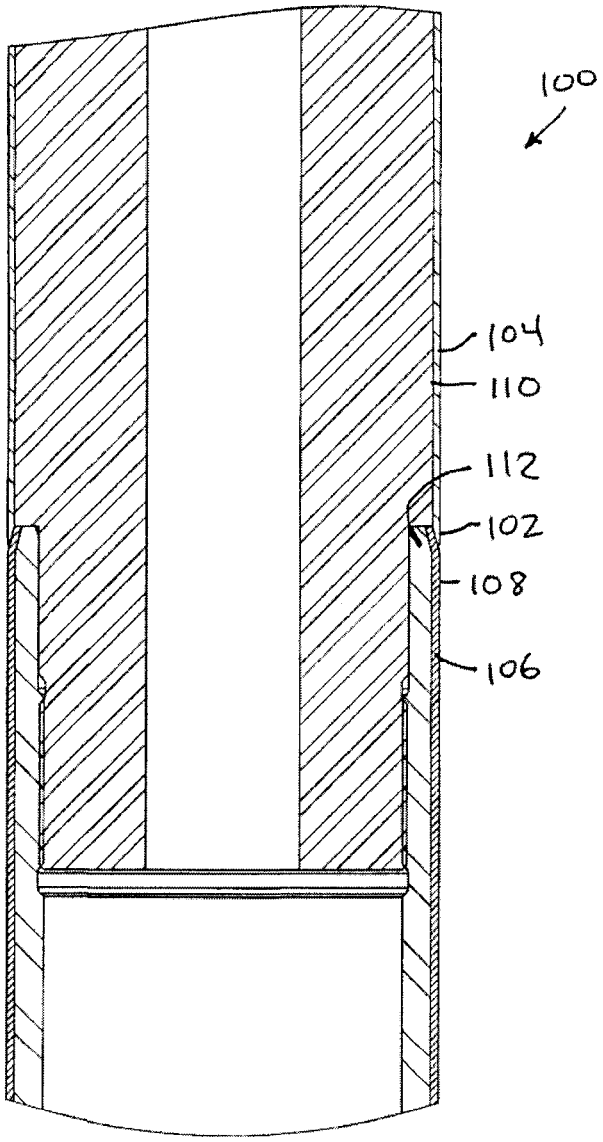
FIG. 5*a* is a sectional view of a third embodiment of the present invention.
Figure 5B:
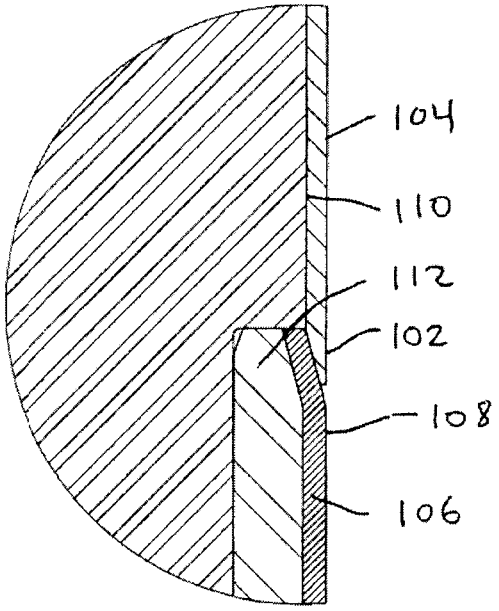
FIG. 5*b* is a detail view of the lip-sleeve interface of the third embodiment.

Turning now to FIGS. 5*a*, 5*b* and 6*a*, 6*b*, two further exemplary embodiments are illustrated. FIGS. 5*a* and 5*b* illustrate an alternative embodiment of a device 100 in which the lip 102 of the retention member 104 is flush with the sleeve 106 outer surface 108, the retention member 104 being a separate component in slip-fit engagement with the external surface 110 (of either the end or the connector, as the case may be, as described above with respect to the other embodiments). This flush arrangement is achieved by tapering the lip 102 and the housing end 112, so that the end of the sleeve 106 angles inwardly under the lip 102.

Figure 6A:
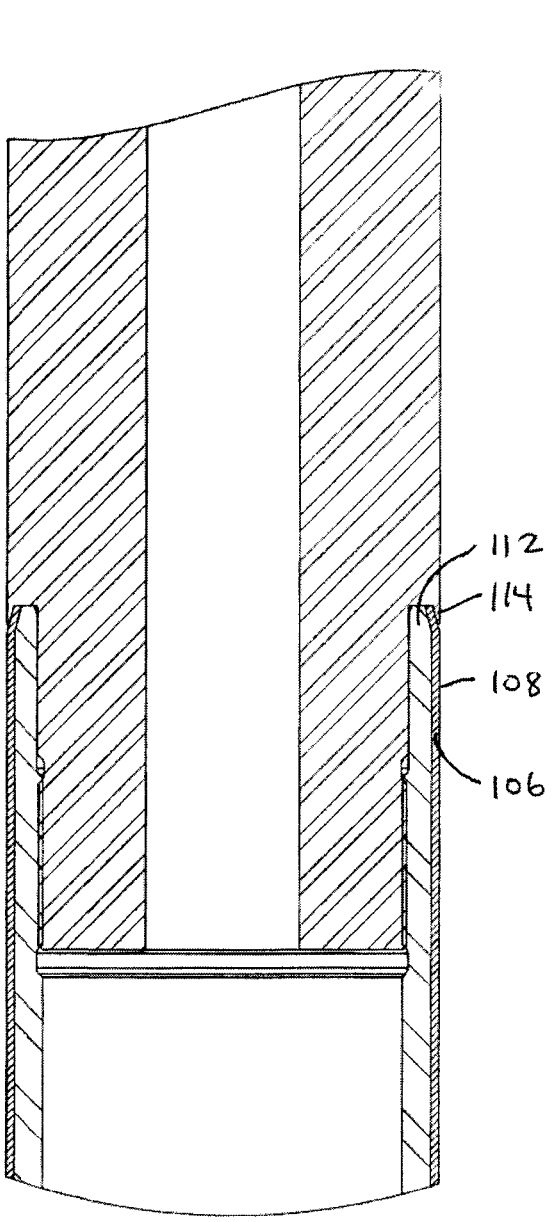
FIG. 6*a* is a sectional view of a fourth embodiment of the present invention.
Figure 6B:
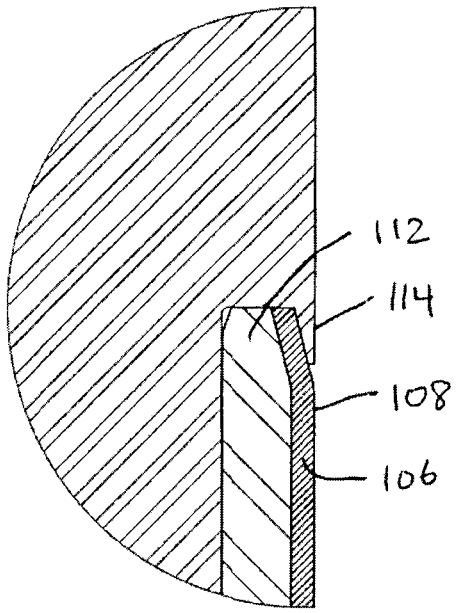
FIG. 6*b* is a detail view of the lip-sleeve interface of the fourth embodiment.

FIGS. 6*a* and 6*b* illustrate a further alternative embodiment, in which the lip 114 is of unitary construction with the end or connector (as the case may be). As with the embodiment of FIGS. 5*a* and 5*b*, the lip 114 is flush with the sleeve 106 outer surface 108, and the flush arrangement is achieved by tapering the lip 114 and the housing end 112, so that the end of the sleeve 106 angles inwardly under the lip 114.

While the above description states that the device or probe may be within a gap sub or gap sub assembly, such description is simplified for the sake of illustration, and those skilled in the art will know that probes are commonly only partially within the gap sub itself.

As will be clear from the above, those skilled in the art would be readily able to determine obvious physical variants capable of providing the retention functionality, in which an end of the sleeve is pressed inwardly against the external surface of the probe, and all such variants and functional equivalents are intended to fall within the scope of the present invention.

The present invention also extends to methods of reducing wear to the external surface of an in-pipe device such as a probe, and of securing protective wear members to such devices.

In one exemplary embodiment of a method according to the present invention, the method is for reducing wear of an external surface of an in-pipe device. Reference will be made to the elements shown in FIG. 2 for ease of description. A sleeve 26*a* is manufactured to a suitable size and configuration for slip-fit engagement with the external surface 28*a* of the downstream housing section 16*a*. Before the housing section 16*a* is connected to the downstream end 12 and the connector 18, the sleeve 26*a* is installed on the external surface 28*a*. The housing section 16*a* is then connected to the downstream end 12, such that the shoulder 20 comes into contact with the downstream end 42 of the sleeve 26*a*. The housing section 16*a* is then connected to the connector 18, such that the shoulder 22 comes into contact with the upstream end 44 of the sleeve 26*a*. The sleeve 26*a* is thus secured between the shoulders 20, 22.

Similarly, the upstream sleeve 26*b* is manufactured to a suitable size and configuration for slip-fit engagement with the external surface 28*b* of the upstream housing section 16*b*. Before the housing section 16*b* is connected to the connector 18, the sleeve 26*b* is installed on the external surface 28*b*. The housing section 16*b* is then connected to the connector 18, such that the shoulder 24 comes into contact with the downstream end 46 of the sleeve 26*b*. As stated above, the upstream end of the upstream sleeve 26*b* would be secured in a manner similar to the way in which the downstream end 12 secures the downstream end 42 of the downstream sleeve 26*a*.

The metal sleeves 30, 32 are then installed over the exterior of the probe 10 by sliding them over one end of the probe 10 and into the desired position. Alternatively, the metal sleeve 30 could be installed on the downstream end 12 and the metal sleeve 32 installed on the connector 18 before assembly of the probe 10. In the case of the downstream metal sleeve 30, the desired position is shown in FIG. 2 in which the lip 36 is positioned at least partially over the downstream end 42 of the sleeve 26*a*; due to the press-fit engagement, the downstream end 42 will thus be pressed against the external surface 28*a* by the lip 36, as described above. Similarly, in the case of the connector metal sleeve 32, the desired position is shown in FIG. 2 in which the lip 38 is positioned at least partially over the upstream end 44 of the sleeve 26*a* while the lip 40 is positioned at least partially over the downstream end 46 of the sleeve 26*b*; due to the press-fit engagement, the upstream end 44 will thus be pressed against the external surface 28*a* by the lip 38 while the downstream end 46 will thus be pressed against the external surface 28*b* by the lip 40, as described above.

Alternatively, with regard to the embodiment illustrated in FIG. 4, the retention means could be of unitary construction with the downstream end (and the upstream end, not shown) and the connector. In that case, the method would not require positioning of downstream and connector metal sleeves 30, 32 but would instead accomplish the retention of the sleeves 26*a*, 26*b* simply by connecting the downstream end 56, housing sections 16*a*, 16*b* and connector 58 once the sleeves 26*a*, 26*b* are installed on the housing sections 16*a*, 16*b*.

With the sleeves 26*a*, 26*b* thus positioned and retained against the external surfaces 28*a*, 28*b*, this exemplary embodiment may help to reduce wear of the external surfaces 28*a*, 28*b* of the probe 10.

In another exemplary embodiment of a method according to the present invention, the method is for securing a wear member against an external surface of a device, the device for insertion within a conduit. Reference will again be made to the elements shown in FIG. 2 for ease of description. A sleeve 26*a* is manufactured to a suitable size and configuration for slip-fit engagement with the external surface 28*a* of the downstream housing section 16*a*. Before the housing section 16*a* is connected to the downstream end 12 and the connector 18, the sleeve 26*a* is installed on the external surface 28*a*. The housing section 16*a* is then connected to the downstream end 12, such that the shoulder 20 comes into contact with the downstream end 42 of the sleeve 26*a*. The housing section 16*a* is then connected to the connector 18, such that the shoulder 22 comes into contact with the upstream end 44 of the sleeve 26*a*. The sleeve 26*a* is thus secured between the shoulders 20, 22. Similarly, the upstream sleeve 26*b* is manufactured to a suitable size and configuration for slip-fit engagement with the external surface 28*b* of the upstream housing section 16*b*. Before the housing section 16*b* is connected to the connector 18, the sleeve 26*b* is installed on the external surface 28*b*. The housing section 16*b* is then connected to the connector 18, such that the shoulder 24 comes into contact with the downstream end 46 of the sleeve 26*b*. As stated above, further retention means would be employed to secure the upstream end of the upstream sleeve 26*b*, such as in a manner similar to the way in which the downstream end 12 secures the downstream end 42 of the downstream sleeve 26*a*.

The metal sleeves 30, 32 are then installed over the exterior of the probe 10 by sliding them over one end of the probe 10 and into the desired position. Alternatively, the metal sleeve 30 could be installed on the downstream end 12 and the metal sleeve 32 installed on the connector 18 before assembly of the probe 10. In the case of the downstream metal sleeve 30, the desired position is shown in FIG. 2 in which the lip 36 is positioned at least partially over the downstream end 42 of the sleeve 26*a*; due to the press-fit engagement, the downstream end 42 will thus be pressed against the external surface 28*a* by the lip 36, as described above. Similarly, in the case of the connector metal sleeve 32, the desired position is shown in FIG. 2 in which the lip 38 is positioned at least partially over the upstream end 44 of the sleeve 26*a* while the lip 40 is positioned at least partially over the downstream end 46 of the sleeve 26*b*; due to the press-fit engagement, the upstream end 44 will thus be pressed against the external surface 28*a* by the lip 38 while the downstream end 46 will thus be pressed against the external surface 28*b* by the lip 40, as described above. Alternatively, with regard to the embodiment illustrated in FIG. 4, the retention means could be of unitary construction with the downstream end (and the upstream end, not shown) and the connector. In that case, the method would not require positioning of downstream and connector metal sleeves 30, 32 but would instead accomplish the retention of the sleeves 26*a*, 26*b* simply by connecting the downstream end 56, housing sections 16*a*, 16*b* and connector 58 once the sleeves 26*a*, 26*b* are installed on the housing sections 16*a*, 16*b*. With the sleeves 26*a*, 26*b* thus positioned and retained against the external surfaces 28*a*, 28*b*, this exemplary embodiment may help to secure a wear member against an external surface of a device, the device for insertion within a conduit. Thus, the sleeves 26*a*, 26*b* are secured in place in a novel manner and without the use of adhesives.

Figure 7:
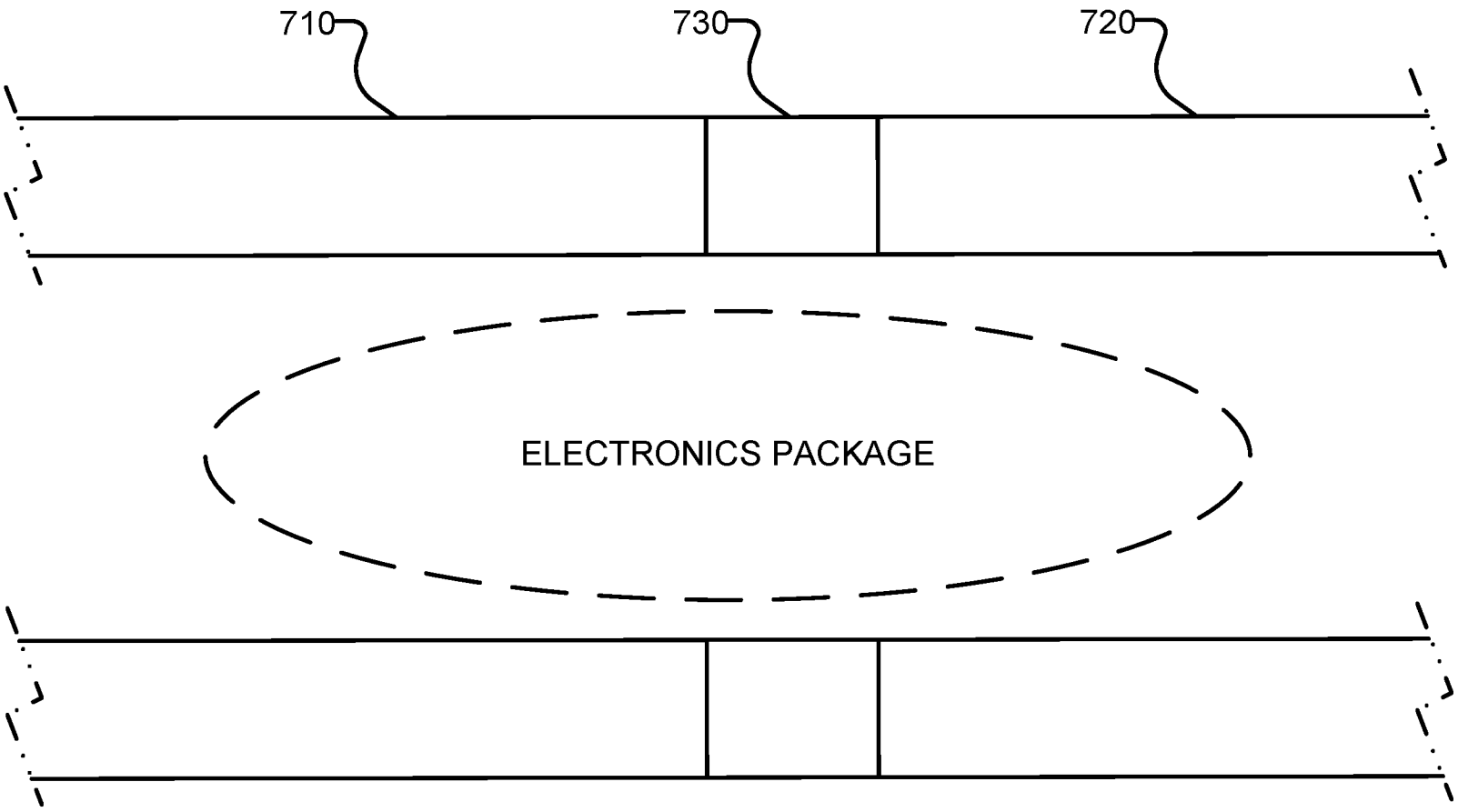
FIG. 7 is a schematic depiction of an electronics package partially within an interior space of a male member, female member, and electrically insulative gap member.

FIG. 7 depicts a gap sub for insertion in a drill string, the gap sub comprising male member 710, female member 720, electrically insulative gap member 730 configured for positioning between the male member 710 and female member 720, the male and female members and the gap member when connected forming an interior space; and an electronics package positioned partially within the interior space.

As will be clear to those of skill in the art, the present invention allows for a wear member application that can easily be replaced. When it is determined that the time has come for the sleeve(s) to be replaced, the device can be withdrawn or the section of conduit or drill pipe/collar can be taken out of operation, and the components can be disconnected in a conventional manner. The upstream and downstream ends of the probe can be pulled away, thus freeing the sleeves from the outwardly positioned lips. The sleeves can then be pulled away from the respective inwardly positioned shoulders and disengaged from the inwardly positioned lips. Replacement sleeves can then be installed and the various components reconnected as described above. The probe can then be returned to operation.

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to".
- "connected", "coupled", or any variant thereof, means any connection or coupling, either direct or indirect, between two or more elements; the coupling or connection between the elements can be physical, logical, or a combination thereof.
- "herein", "above", "below", and words of similar import, when used to describe this specification shall refer to this specification as a whole and not to any particular portions of this specification.
- "or", in reference to a list of two or more items, covers all of the following interpretations of the word: any of the items in the list, all of the items in the list, and any combination of the items in the list.
- the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of methods and apparatus have been described herein for purposes of illustration. These are only examples. The technology provided herein can be applied to contexts other than the exemplary contexts described above. Many alterations, modifications, additions, omissions and permutations are possible within the practice of this invention. This invention includes variations on described embodiments that would be apparent to the skilled person, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

The foregoing is considered as illustrative only of the principles of the invention. The scope of the claims should not be limited by the exemplary embodiments set forth in the foregoing, but should be given the broadest interpretation consistent with the specification as a whole.

The invention claimed is:

1. An apparatus comprising a wear assembly and a downhole probe, the downhole probe for positioning within an interior space of a conduit, the apparatus comprising:

a downhole probe having an external surface;

a wear member comprising a deformable sacrificial sleeve of a plastic material sized and configured for slip-fit engagement with the external surface of the downhole probe; and a retention member comprising at least one projection extending adjacent the sacrificial sleeve, the retention member configured to press against at least a portion of an outer surface of the sacrificial sleeve such that an inner surface of the sacrificial sleeve is pressed against the external surface of the probe.

2. The apparatus of claim 1 wherein the at least one projection comprises a lip extending in a downstream direction, the lip configured to press a portion of an upstream end of the sacrificial sleeve against the external surface of the probe.

3. The apparatus of claim 1 wherein the at least one projection comprises a circumferential lip extending around the probe and generally parallel to the external surface of the probe, the circumferential lip configured to press a portion of the upstream end of the sacrificial sleeve against the external surface of the probe.

4. The apparatus of claim 1 wherein the probe comprises an electronics package.

5. The apparatus of claim 1 wherein the retention member is composed of a material selected from the group consisting of beryllium copper and stainless steel.

6. An apparatus comprising a wear assembly and a downhole probe, the probe for positioning within an interior space of a conduit, the apparatus comprising:

a downhole probe having an external surface;

a deformable sacrificial sleeve of a plastic material sized and configured for slip-fit engagement with the external surface of the probe; and at least one retention member;

the at least one retention member comprising at least one protuberance for securing an upstream end of the sleeve against the external surface of the probe.

7. The apparatus of claim 6 wherein the sleeve is composed of a plastic material, the plastic material deformable when fluid flowing through the conduit flows under the upstream end of the sleeve, the protuberance sized and configured to retain the upstream end of the sleeve against the external surface of the probe to reduce the flow of the fluid under the upstream end of the sleeve.

8. The apparatus of claim 6 wherein the probe comprises an electronics package.

9. The apparatus of claim 6 wherein the at least one retention member is composed of a material selected from the group consisting of beryllium copper and stainless steel.

10. The apparatus of claim 6 wherein the conduit comprises a gap sub assembly and the sleeve is composed of an electrically insulative material.

11. The apparatus of claim 10 wherein the electrically insulative material is selected from the group consisting of polyphenylene sulfide, polyethylene terephthalate and polyether ether ketone.

12. The apparatus of claim 6 wherein the at least one protuberance comprises a circumferential lip adjacent the sleeve.

13. The apparatus of claim 6 wherein the probe comprises a shoulder for abutting engagement with the upstream end of the sleeve.

14. The apparatus of claim 6 further comprising at least one downstream retention member for securing a downstream end of the sleeve against the external surface of the probe.

15. The apparatus of claim 6 wherein:

the sacrificial sleeve comprises upstream and downstream sleeves sized and configured for slip-fit engagement with the external surface, the upstream and downstream sleeves configured for positioning adjacent one another; and further comprising downstream and central retention members;

the at least one retention member for securing an upstream end of the upstream sleeve against the external surface, the downstream retention member for securing a downstream end of the downstream sleeve against the external surface, and the central retention member for securing both a downstream end of the upstream sleeve and an upstream end of the downstream sleeve against the external surface.

16. The apparatus of claim 15 wherein:

the downstream retention member comprises at least one protuberance for securing the downstream end of the downstream sleeve against the external surface, and the central retention member comprises at least two protuberances, one for securing each of the downstream end of the upstream sleeve and the upstream end of the downstream sleeve against the external surface.

17. A gap sub for insertion in a drill string, the gap sub comprising:

a male member;

a female member;

an electrically insulative gap member configured for positioning between the male and female members;

the male and female members and the gap member when connected forming an interior space;

an electronics package for positioning partially within the interior space, the electronics package having an external surface;

a deformable sacrificial sleeve of a plastic material for slip-fit engagement with the external surface; and at least one retention member sized and configured to secure an upstream end of the sleeve against the external surface and reduce introduction under the sleeve of fluid flowing through the gap sub.

18. The gap sub of claim 17 wherein the at least one retention member comprises at least one protuberance for bearing against the upstream end of the sleeve to press the upstream end against the external surface.

19. The gap sub of claim 18 wherein the protuberance comprises a circumferential lip.

* * * * *